399-235 SR

C2358 OR 4,600,294

United States Patent [19]

Suzuki et al.

[11] Patent Number: 4,600,294

[45] Date of Patent: Jul. 15, 1986

[54] IMAGE FORMING APPARATUS WITH DETECTOR AND CONTROL

[75] Inventors: Koji Suzuki; Jyoji Nagahira, both of Yokohama; Kazuyoshi Takahashi, Kawasaki; Kunio Yoshihara, Tokyo; Toshiro Matsui, Kawasaki; Tadashi Ishikawa, Tokyo, all of Japan

[73] Assignee: Canon Kabushiki Kaisha, Tokyo, Japan

[21] Appl. No.: 592,545

[22] Filed: Mar. 23, 1984

[30] Foreign Application Priority Data

| | | | |
|---|---|---|---|
| Apr. 1, 1983 | [JP] | Japan | 58-55151 |
| Apr. 1, 1983 | [JP] | Japan | 58-55152 |
| Apr. 1, 1983 | [JP] | Japan | 58-55153 |
| Apr. 1, 1983 | [JP] | Japan | 58-55154 |
| Apr. 1, 1983 | [JP] | Japan | 58-55155 |
| Apr. 1, 1983 | [JP] | Japan | 58-55156 |

[51] Int. Cl.[4] ..... G03G 15/08

[52] U.S. Cl. ..... 355/14 D; 355/3 DD

[58] Field of Search ..... 355/14 R, 14 CU, 3 R, 355/3 DD, 14 D; 430/120; 118/653, 624, 663, 691, 712

[56] References Cited

U.S. PATENT DOCUMENTS

| | | | |
|---|---|---|---|
| 3,654,893 | 4/1972 | Piper et al. | 118/624 X |
| 3,788,739 | 1/1974 | Coriale | 355/14 CH X |

*Primary Examiner*—A. C. Prescott

*Attorney, Agent, or Firm*—Fitzpatrick, Cella, Harper & Scinto

[57] ABSTRACT

There is disclosed an electrophotographic image forming apparatus in which toner loss by deposition to non-image area is prevented by detecting the surface status of photosensitive member and applying thus detected state to the image developing device.

24 Claims, 17 Drawing Figures

IMAGE FORMING APPARATUS WITH DETECTOR AND CONTROL

BACKGROUND OF THE INVENTION

1. Field of the Invention

The present invention relates to an image forming apparatus such as a copier, and more particularly to such apparatus capable of detecting image forming conditions and controlling image forming means by the output of said detection.

2. Description of the Prior Art

There are already known copiers in which an image is formed on a recording sheet by means of a photosensitive drum and through steps of charging, exposure, image development and image transfer.

In a conventional copier in which the photosensitive drum and the developing sleeve are driven by a common driving source, the toner is deposited from the sleeve onto the photosensitive drum according to the potential thereof, since said drum and sleeve are simultaneously driven.

In consideration of such drawback, there is already employed, in the conventional copier, a method of applying so-called blank exposure to the non-image area of the photosensitive drum to prevent such toner deposition. Also there is employed a method of switching the developing bias voltage to a value not causing such toner deposition.

However, in a copier equipped with an automatic control mechanism for stabilizing the image density by detecting the potential of the latent image with a potential sensor and controlling the image forming conditions by the result of said detection, it has been necessary to employ a blank exposure lamp of a high intensity with an accordingly high power consumption or to employ a high developing bias voltage for the negative toner in order to prevent the toner deposition in the non-image area, since the non-image area eventually contains not only the light area potential but also the dark area potential, because of the facts that such light potential and dark potential have to be both formed on the photosensitive drum for image density control and that the blank exposure lamp requires a long stabilizing time and is inevitably associated with considerable fluctuation in the light intensity.

As an example, in a copier employing a CdS photosensitive drum with a dark potential of +500 V, a bias voltage of +600 V is given to the developing roller for preventing the toner deposition in the non-image area.

On the other hand, the photosensitive drum is known to show a certain developing characteristic, called reversal development, as shown in FIG. 1 in relation to the surface potential, wherein the toner starts to be attracted to the photosensitive drum (for zero developing bias) if the surface potential of the drum exceeds a certain value (−500 V in case of FIG. 1) even when it is repulsive in polarity to the charge of the toner. Consequently, if the developing bias is fixed for example at +600 V as explained before, a considerable amount of toner is consumed by deposition to the photosensitive drum in the non-image area, corresponding to a low potential area or a lighted area.

SUMMARY OF THE INVENTION

In consideration of the foregoing, an object of the present invention is to provide an image forming apparatus capable of preventing wasteful toner consumption.

Another object of the present invention is to provide an image forming apparatus capable of preventing toner deposition in the non-image area.

Still another object of the present invention is to provide an image forming apparatus capable of controlling developing means according to the surface status of a recording member.

Still another object of the present invention is to provide an image forming apparatus in which a value corresponding to the surface status of the recording member detected in a non-image area thereof is supplied to developing means with a delay of a determined period.

The foregoing and still other objects of the present invention will become fully apparent from the following description.

BRIEF DESCRIPTION OF THE DRAWINGS

FIGS. 10A-1, 10A-2 and 10B are flow charts showing the control sequence in case of controlling the developing bias according to the change in the detected potential.

DETAILED DESCRIPTION OF THE PREFERRED EMBODIMENTS

Now the present invention will be clarified in detail by an embodiment shown in the attached drawings wherein the present invention is applied to a copier.

Figure 2:
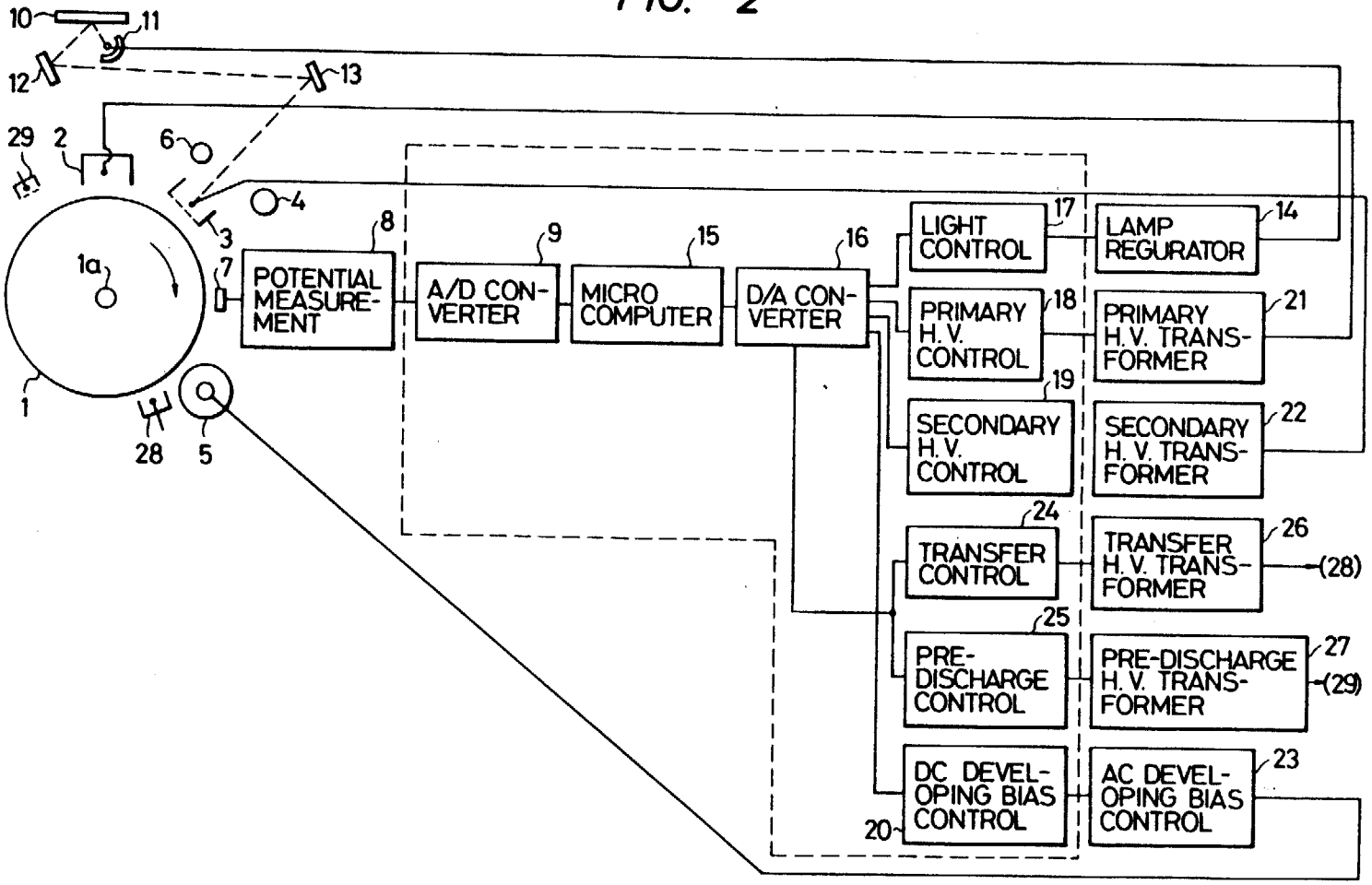
FIG. 2 is a schematic view showing the arrangement of the image forming apparatus of the present invention.

FIG. 2 schematically shows the structure of the copier of the present invention, wherein a photosensitive drum 1 is for example composed of three layers namely an insulating layer, a photoconductive layer and a conductive layer from the external periphery, and is rotatably supported in the unrepresented body by a shaft 1a. Along the periphery of said photosensitive drum 1 there are provided, in the order of rotation, a primary charger 2, a secondary charger 3, an overall exposure lamp 4, a potential sensor 7, a developing roller 5 of a developing station, a transfer charger 28 and a charger 29 for preliminary charge elimination.

The photosensitive drum 1, subjected to the preliminary charge elimination by the charger 29 prior to other steps, is uniformly charged by the primary charger 2, and is exposed to the light reflected from an original 10, which is illuminated by an exposure lamp 11, and transmitted through mirrors 12, 13. Simultaneously charge elimination is conducted according to the original image by the secondary charger 3. Then the drum is uniformly exposed to the light from the overall exposure lamp 4, and the obtained latent image is developed with toner by the developing roller 5. As will be explained later, an AC bias voltage is supplied to said developing roller 5 to control the image toner by the jumping development. Subsequently the transfer charger 28 is activated to transfer the toner image onto a recording sheet. Above the secondary charger 3 there is provided a blank exposure lamp 6 for forming light and dark potentials to be explained later. Said blank exposure lamp 6 also prevents the toner deposition onto the non-image area of the photosensitive drum 1.

The non-image area mentioned herein includes a drum area corresponding to the drum cleaning step in the non-imaging cycles such as at the start of power supply, at the actuation of the copy start key or at the completion of a copying cycle, and also a drum area corresponding to the reversing motion of the optical system or the original carriage. Also included is a drum area in the steps of standardizing the image forming conditions and of measuring the original density, both conducted during the prerotation of the photosensitive drum after the copy start key is actuated. Furthermore included is a drum area along the lateral edge of the drum not contributing to the image transfer.

Between the overall exposure lamp 4 and the developing roiler 5 there is provided a potential sensor 7 for measuring the surface potential of the photosensitive drum 1, and a signal from said potential sensor 7 is supplied, through a potential measuring circuit 18, to an A/D converting circuit 9 for conversion into a digital signal, which is supplied to a microcomputer 15. The output signal thereof is supplied to a D/A converting circuit 16 which is connected to a light control circuit 17, a primary high-voltage control circuit 18, a secondary high-voltage control circuit 19, a transfer control circuit 24, a preliminary charge elimination control circuit 25 and a DC developing bias control circuit 20. The light control circuit 17 controls the exposure lamp 11 through a lamp regulator 14, while the primary and secondary high-voltage control circuits 18, 19 are respectively connected, through primary and secondary high-voltage transformers 21, 22, to the primary and secondary chargers 2, 3 to determine the charges thereof. Also the transfer control circuit 24 is connected through a transfer high-voltage transformer 26 to the transfer charger 28, while the preliminary charge elimination control circuit 25 is connected, through a high-voltage transformer 27, to the charger 29. The output of the DC developing bias control circuit 20 is supplied to the AC developing bias control circuit 23 of which output is supplied to the developing roller 5.

Figure 3:
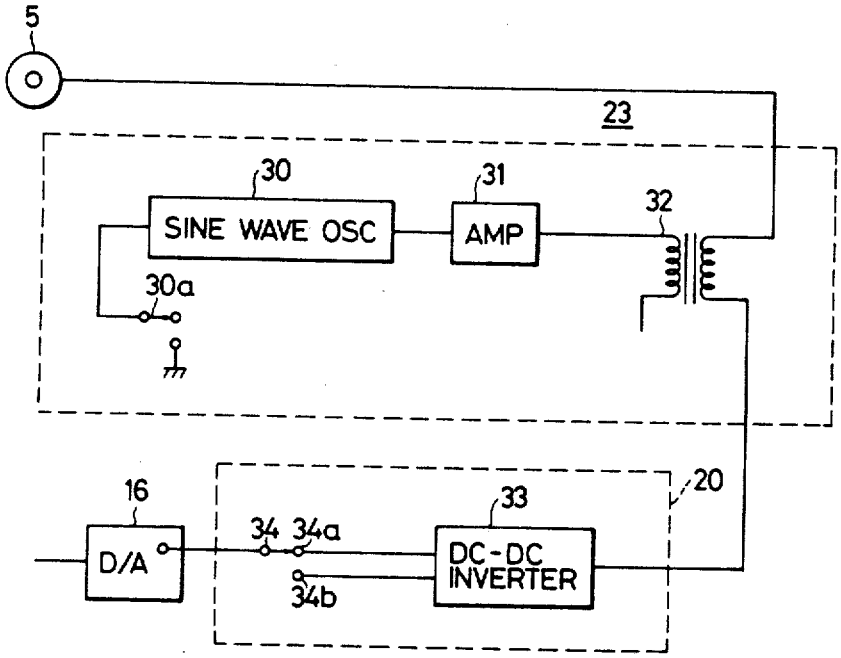
FIG. 3 is a block diagram of a developing control circuit for use in the image forming apparatus of the present invention.

The DC developing bias control circuit 20 and the AC developing bias control circuit 23 mentioned above are constructed as shown in FIG. 3. A sinusoidal wave oscillator 30 is connected to an amplifier 31 to provide an AC voltage to the primary side of a voltage-elevating transformer 32, of which the secondary side supplies a high voltage to the developing roller 5.

The other end of the secondary side of said transformer 32 is connected to a DC-DC inverter 33, which is further connected through a switch 34 to the D/A converter 16 to constitute the DC developing bias control circuit 20 shown in FIG. 2. Said switch 34 is positioned at 34*a* or 34*b* respectively in the manual or automatic exposure mode, thus generating different bias voltages.

Figure 4:
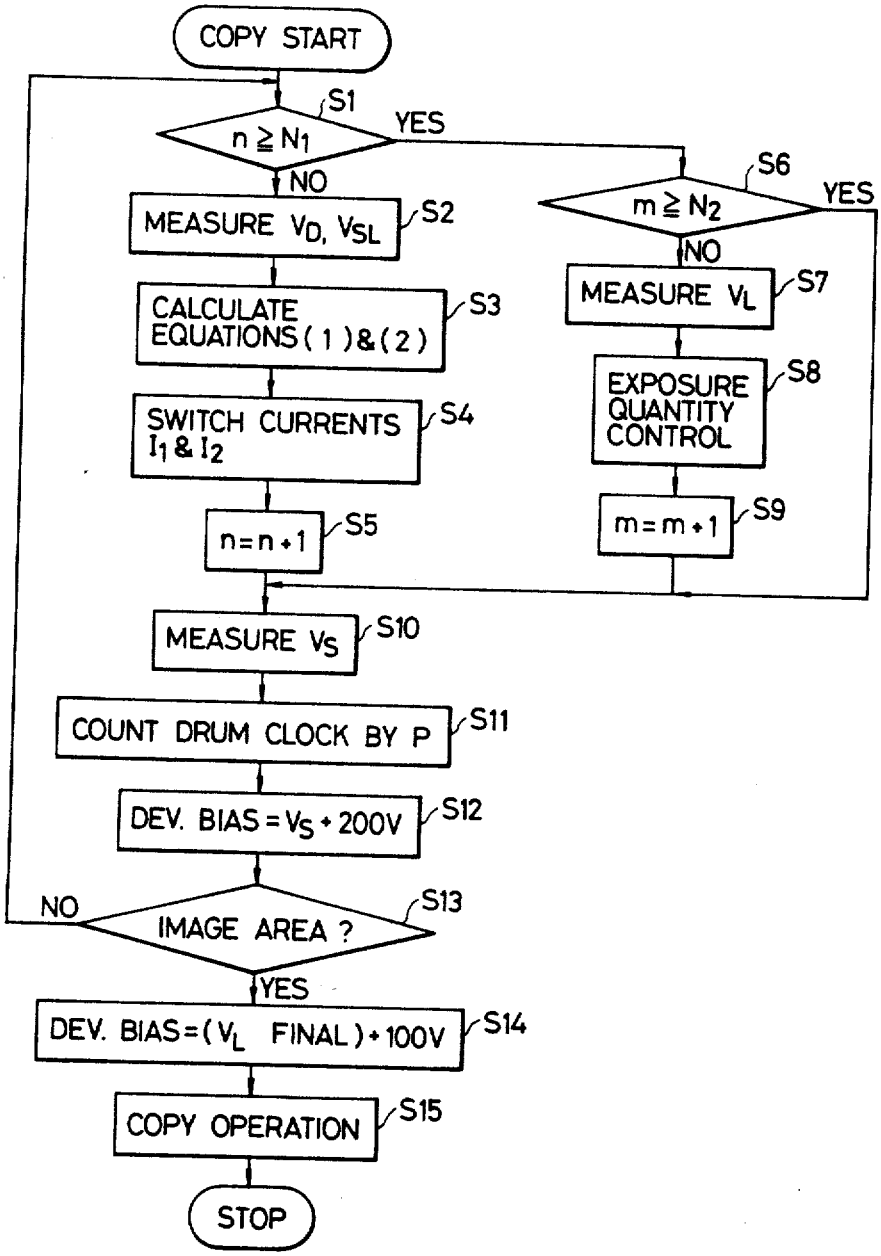
FIG. 4 is a flow chart showing the control sequence in case of controlling the developing bias according to the potential detected in a potential control area.

Now reference is made to the flow chart shown in FIG. 4 for explaining the function of the above-explained circuit.

At the start of a copying operation, a step S1 identifies the number of measurements of the light and dark potentials and of charge control routines to be conducted in steps S2 to S4. It is assumed in the present embodiment that the charge control is conducted N1 times.

If the number of executed routines has reached N1, the program proceeds to a measurement routine of steps S6 to S9 to be explained later. On the other hand, if said number N1 has not been reached, the program proceeds to a step S2.

The step S2 intermittently lights the exposure lamp 11 or the blank exposure lamp 6 to form, on the photosensitive drum, a strong light potential $V_{SL}$ caused by a strong exposure and a dark potential $V_D$ caused by a turned-off lamp. These surface potentials are detected by the potential sensor 7, converted to determined levels by a potential measuring circuit 8, further converted into digital signals by an A/D converter 9 and supplied to the microcomputer 15.

In a subsequent step S3, the digitally converted surface potentials are processed in the microcomputer 15 to form control data to be supplied to the succeeding circuits for bringing the light potential and the dark potential toward the target values.

More specifically, the primary current $I_1$ and the secondary current $I_2$ to be respectively supplied to the primary and secondary chargers 2, 3 are determined according to the following formulas:

$$\Delta I_1 = \alpha_1 \Delta V_D + \alpha_2 \Delta V_{SL} \quad (1)$$

$$\Delta I_2 = \beta_1 \Delta V_D + \beta_2 \Delta V_{SL} \quad (2)$$

wherein $\Delta I_1$ and $\Delta I_2$ represent variations, $\Delta V_D$ and $\Delta V_{SL}$ represent deviations from the target values, and $\alpha_1$, $\alpha_2$, $\beta_1$ and $\beta_2$ are control coefficients.

In a step S4, the control data determined in the above-described manner are converted into analog signals in the D/A converter 16, and supplied to the primary and secondary high-voltage control circuits 18, 19. The primary high-voltage control circuit 19 controls the primary high-voltage transformer 21, thus controlling the amount of charge to be given by the primary charger 2. Also the secondary high-voltage control circuit 19 controls the secondary high-voltage transformer 22, thus controlling the amount of charge to be given by the secondary charger 3. In this manner the light potential $V_{SL}$ and the dark potential $V_D$ are controlled toward the target values.

Then a step S5 causes a stepwise increment of a counter indicating the number of executed routines, and the program proceeds to a step S10.

The above-explained charge control routine is conducted, through steps S10–S13, N1 times which are dependent on the unoperated period of the apparatus.

A subsequent step S6 identifies the number of exposure control routines to be executed in steps S7 to S8. It is assumed in the present embodiment that the exposure control routine in the steps S7 and S8 is conducted $N_2$ times. If said number $N_2$ has not been reached, the program proceeds to a step S7, while the program proceeds to the step S10 if said number $N_2$ has been reached.

In the step S7, the blank exposure lamp 6 is turned off while the original exposure lamp 11 is turned on to illuminate an unrepresented standard white plate positioned outside the image area of the original 10 and to measure the reflected light. Thus the intensity of the original exposure lamp 11 is controlled toward a standard intensity.

A first illumination is achieved by providing the original exposure lamp 11 with a lighting voltage $V_{HL}$ obtained by converting determined data from the microcomputer 15 into analog signals by the D/A converter 16 and supplying said analog signals through the light control circuit 17 and the lamp regulator 14. The reflected light from the standard white plate in said first illumination is guided to the photosensitive drum 1, and a potential formed thereon corresponding to a white area (white or light potential $V_L$) is measured through the potential sensor 7 and the primary high-voltage control circuit 18.

In a step S8, the measured potential is converted into a digital signal by the A/D converter 9 and supplied to the microcomputer 15 to execute a calculation according to the following equation:

$$\Delta V_{HL} = \gamma_1 \cdot \Delta V_L$$

wherein $\Delta V_L$ is the deviation from the target while $\gamma_1$ is a constant.

The result of said calculation is converted into an analog signal by the D/A converter 16 and used for controlling the intensity of the original exposure lamp 11 through the lamp regulator 14 in such a manner as to bring the white potential $V_L$ to the target value. Said exposure control is conducted N2 times dependent on the unoperated period of the apparatus and is counted in a step S9 by a counter, and the step S6 discriminates whether said number N2 has been reached.

In a step S10, the latent image potential $V_s$ of the photosensitive drum 1 is measured by the potential sensor 7.

A subsequent step S11 measures the rotating time of the photosensitive drum 1 from the potential sensor 7 to the developing roller 5. Said measurement is for example achieved by generating pulses from an unrepresented encoder mounted on the rotary shaft of the photosensitive drum 1 and counting the number P of said pulses corresponding to the rotating angle.

A subsequent step S12 adds +200 V to the measured latent image potential $V_s$, and supplies thus added value as the developing bias voltage to the developing roller 5.

The program returns to the step S1 if a step S13 identifies that the non-image area has not passed.

As explained above, in the copying sequence, the charge control and the exposure control are respectively conducted N1 and N2 times in the steps S2-S5 and S7-S9, and the developing bias control is conducted in the steps S10-S12. Said developing bias control is conducted, in order to prevent toner deposition in the non-image area, in repeated manner until the step S13 identifies that the non-image area has come to the end and is replaced by the image area. In practice, in the step S13, the end of the non-image area is identified by the completion of the charge control and exposure control in the steps S1-S9.

Upon identification of the end of the non-image area in the step S13, a step S14 adds 100 V to the final value of the white potential $V_L$ obtained in the aforementioned manner, and supplies thus added value as the developing bias voltage to the developing station, and a normal copying operation is initiated in a step S15.

As explained in the foregoing, the latent image potential measured at the position of the potential sensor 7 is supplied to the developing station 5 with a delay corresponding to the rotating time of the photosensitive drum 1 to said developing station 5, so that, in the non-image area where the charge control and exposure control are conducted, the developing bias voltage is always maintained +200 V higher than the surface potential of the photosensitive drum facing the developing station. Consequently the difference of potentials between the photosensitive drum and the developing sleeve is always maintained at a constant value (200 V) suitable for preventing the toner deposition, thus avoiding loss of toner by deposition in the non-image area of the photosensitive drum.

After the standardization of image forming conditions such as the charge control and exposure control as explained before, there may be conducted optimization of the image forming conditions according to the original by measuring the density thereof and effecting the controls of exposure, charge, developing bias etc. according to the result of said measurement (hereinafter called automatic exposure (AE) control).

Figure 5:
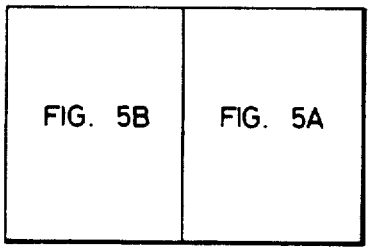
FIGS. 5A, 5B, 6A and 6B are flow charts showing the control sequence in case of controlling the developing bias according to the potential detected in a potential control area and in an original density measuring area.
Figure 5A:
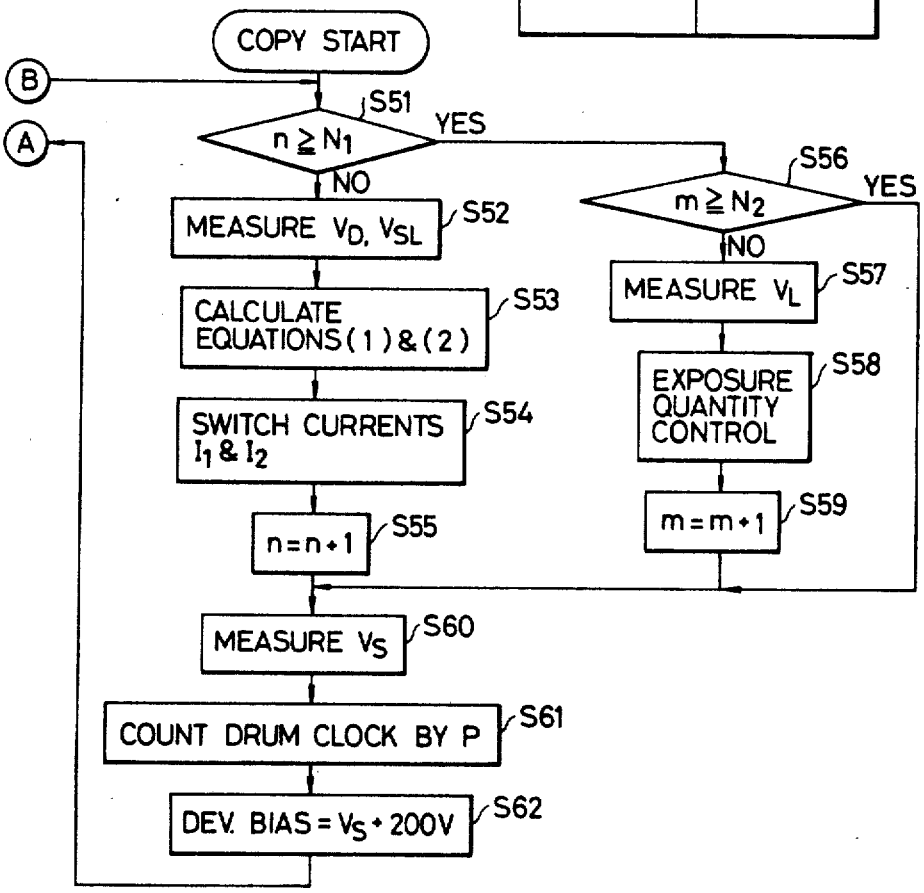
Figure 5B:
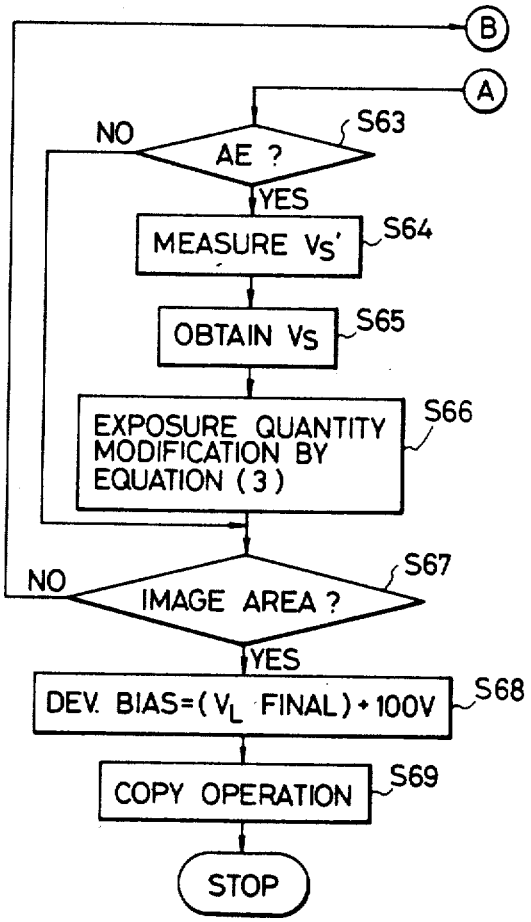

FIG. 5 shows a flow chart for preventing toner deposition in such AE control, by causing the developing bias voltage to follow the measured surface potential also in an area of original density measurement. In said flow chart, steps S51-S62 are similar to the steps shown in FIG. 4 and are therefore omitted from the following explanation.

A step S63 identifies whether or not to proceed to an original density measuring routine (AE routine) of steps S64-S66, by determining whether the above-mentioned measuring routine of the steps S51-S55 and S56-S59 has been conducted a determined number of times. In case of a negative identification in the step S63, the program proceeds to a step S67 to be explained later.

When the charge control and exposure control have been completed a determined number of times, an exposure correction according to the original density is conducted in steps S64-S66.

At first a step S64 activates the aforementioned optical system to scan the original 10 under the conditions of charging and exposure determined as aforementioned, thus forming a latent image potential $v_s'$ on the photosensitive drum 1 by the light reflected from said original 10, and measures said latent image potential with the potential sensor 7.

Then, in a step S65, the measured value is supplied, as explained before, to the microcomputer 15 for calculating an average value $V_s$ of the latent image potential $v_s'$ over the scanning period of the original.

In a subsequent step S66, the microcomputer 15 determines, from the average latent image potential $V_s$ dependent on the original density, a correcting value $\Delta V_{HL}$ for the lighting voltage of the exposure lamp 11 in the image area, according to the following equation:

$$\Delta V_{NL} = \varepsilon \Delta V_s \quad (3)$$

wherein $\Delta V_s$ is the deviation between the average value $V_s$ and a reference value corresponding to the standard original density.

A succeeding step S67 identifies whether the control of the above-mentioned image forming conditions has been completed and the image area is started. The program returns to the step S51 in case of negative identification in the step S67, namely if the control in the steps S51–S59 has not been repeated a determined number of times.

When the end of the non-image area is identified in the step S67, a step S68 adds 100 V to the final value of the white potential $V_L$ determined in the steps S56–S59 to supply thus added value as the developing bias voltage to the developing roller 5, and the normal copying operation is initiated in a step S69.

In this manner useless toner consumption can be avoided also in the AE control, since the developing bias voltage follows the measured surface potential also in the area in which the original density is measured.

Figure 6:
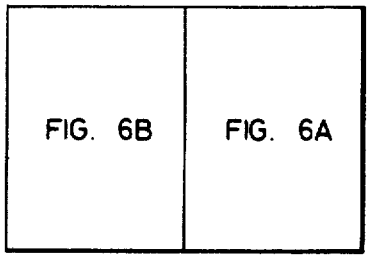
Figure 6A:
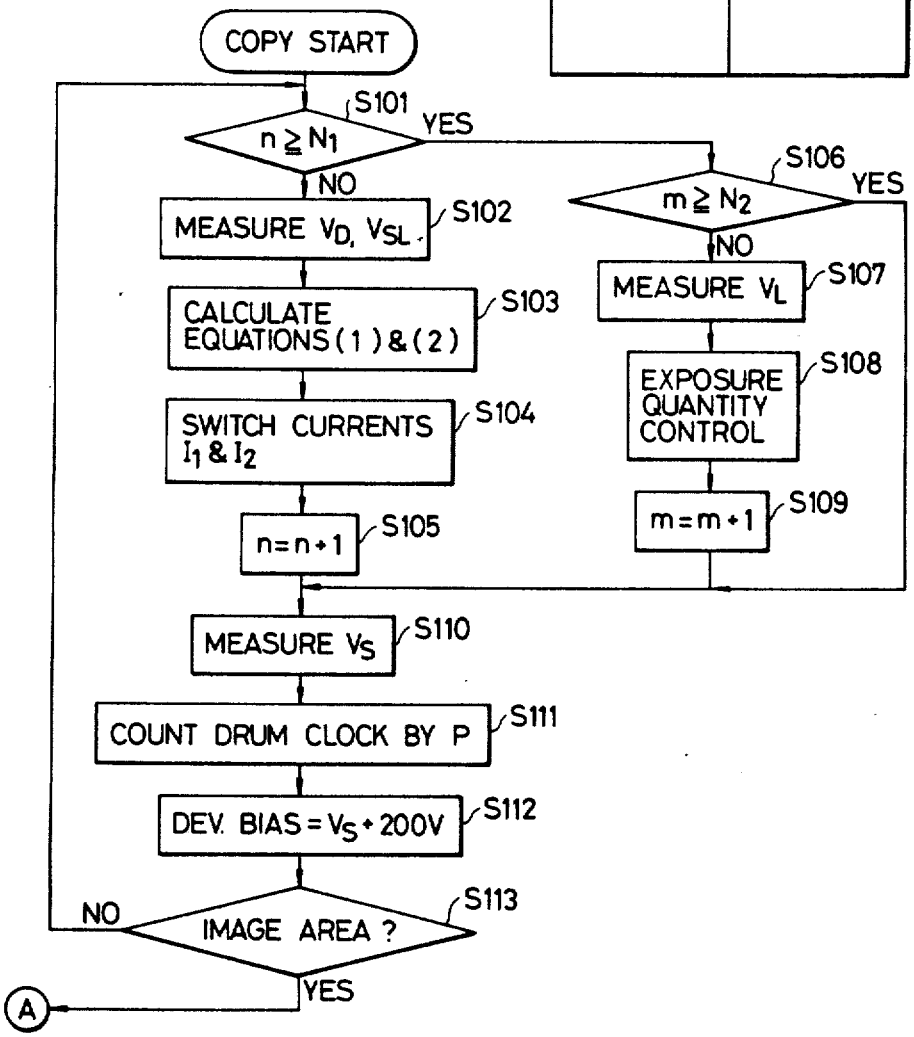
Figure 6B:
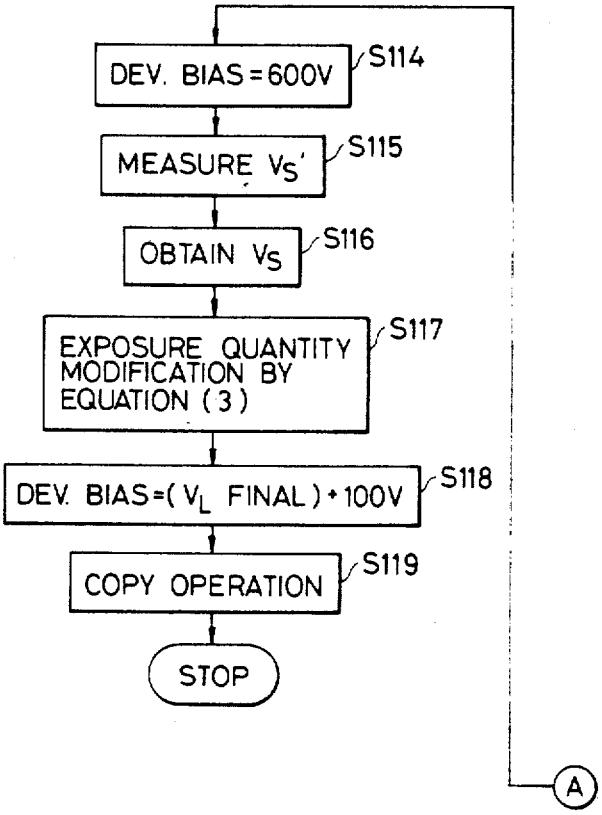

FIG. 6 shows a flow chart of an embodiment in which the useless toner consumption is prevented by maintaining a constant developing bias voltage (600 V) under the AE control. In said flow chart the steps S101–S113 are similar to the steps shown in FIG. 4 and are therefore omitted from the following explanation.

Figure 1:
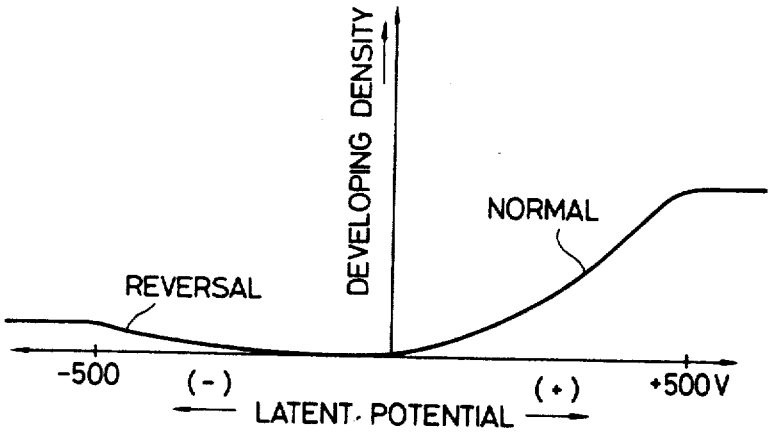
FIG. 1 is a chart showing developing characteristic, as a function of the surface potential, in an image forming apparatus such as a copier.
Figure 7A:
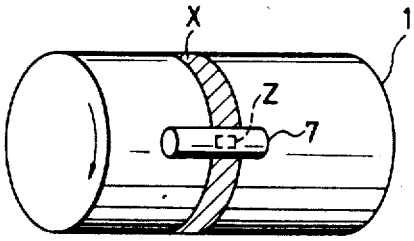
FIGS. 7A and 7B are schematic views showing positional relationship between the photosensitive drum and the potential sensor.
Figure 7B:
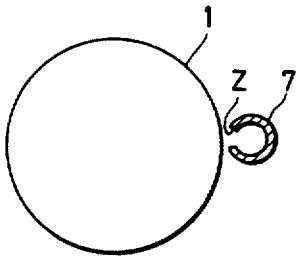

A step S114 applies a fixed developing bias voltage, for example +600 V, to the developing station 5 prior to the original density measurement in steps S115–S117. As the potential sensor 7 scans, as shown in FIGS. 7A and 7B, an area X on the photosensitive drum 1 in the vicinity of an aperture Z of the casing for the sensor, there may result toner deposition not only by the reversal development shown in FIG. 1 but also by normal development if the developing bias voltage is changed only in response to the result of measurement in said area X.

Ensuing steps S115–S119 are similar to the steps S64–S66, S68 and S69 shown in FIG. 5 and are therefore omitted from the following explanation.

The above-described control allows avoidance of useless toner consumption also in the AE control, since a constant developing bias voltage (600 V) sufficient for preventing toner deposition is maintained in the area in which the original density is measured.

Figure 8:
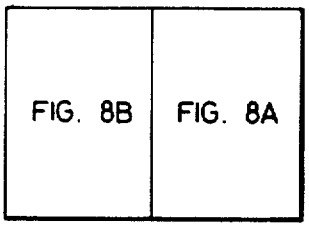
FIGS. 8A and 8B are a flow chart showing the control sequence in case of controlling the developing bias with the detected potential delayed through a memory.
Figure 8A:
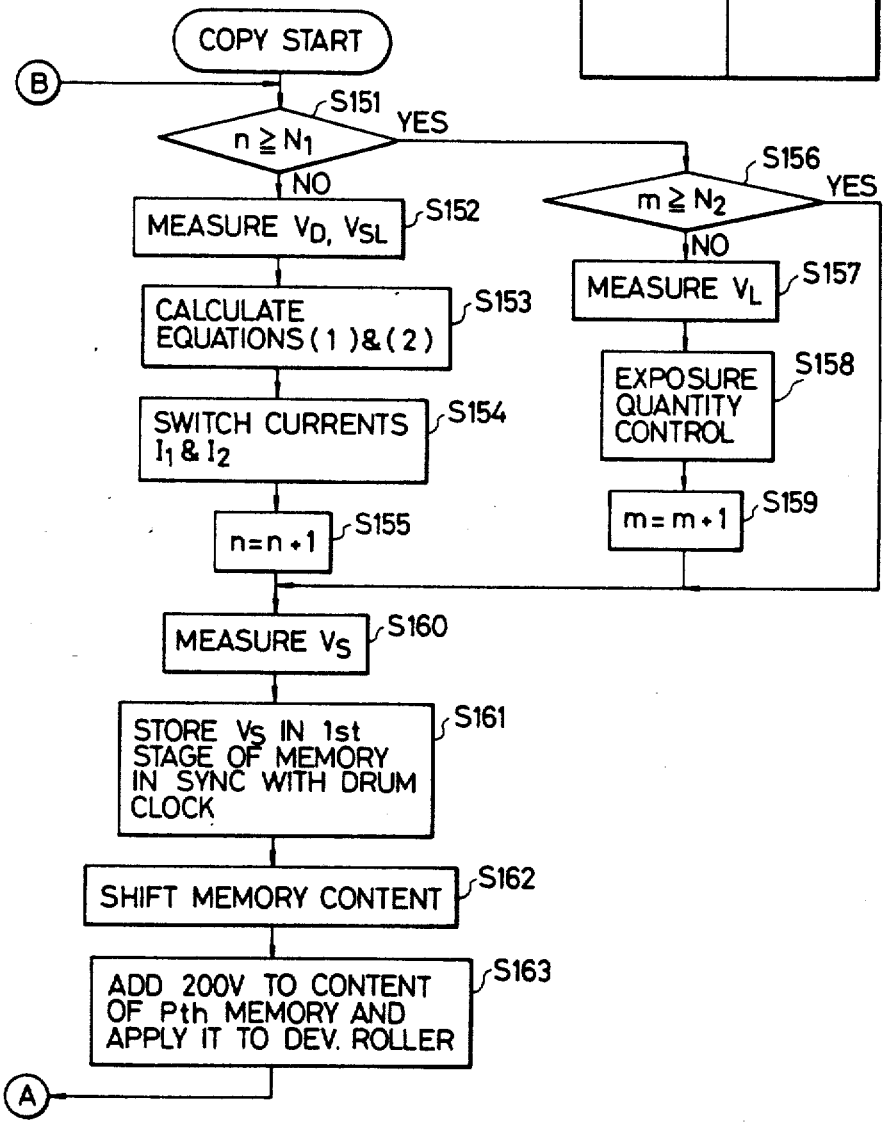
Figure 8B:
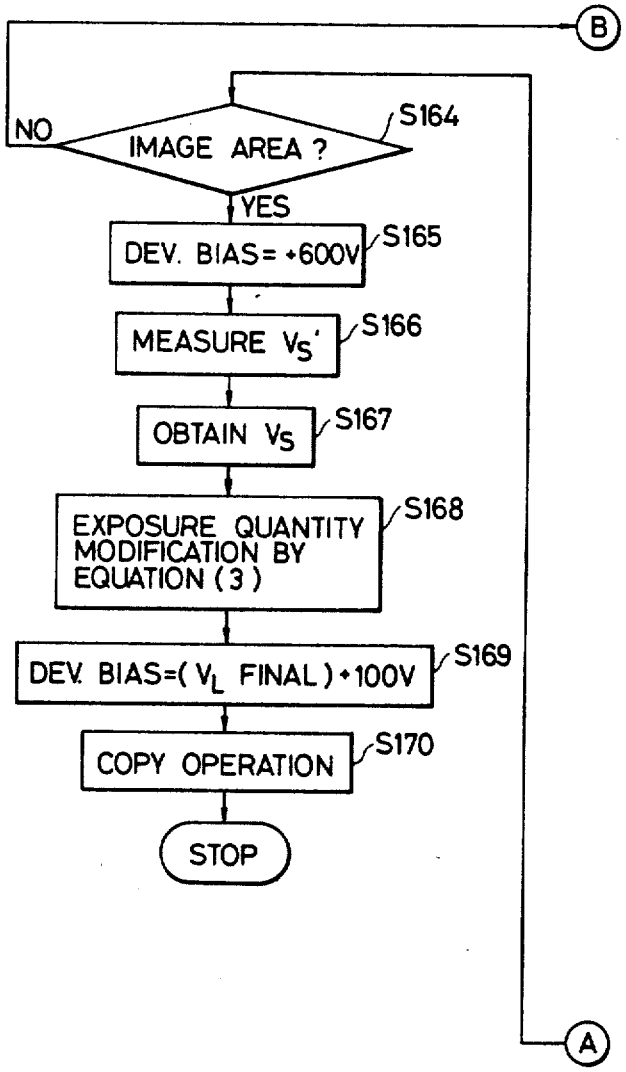

In case of applying a developing bias voltage corresponding to the detected surface potential to the developing station with a delay, said delay may also be achieved with a memory such as a shift register. FIG. 8 shows a flow chart of such embodiment, wherein steps S151–S159 and S164–S170 are similar to the steps S101–S109 and S113–S119 shown in FIG. 6 and are therefore omitted from the following explanation.

In a step S160, the potential sensor 7 measures the surface potential $v_s$ of the photosensitive drum 1.

In a succeeding step S161, the surface potential $v_s$ measured in the step S160 is stored in the first of serial P memory cells provided in the microcomputer 15. Said number P is equal to the number of pulses generated by a known encoder provided on the photosensitive drum 1, during rotation thereof from the potential sensor 7 to the developing roller 5. Said memory cells can be composed for example of a shift register.

A succeeding step S162 shifts the contents of the memory cells respectively to the succeeding memory cells in synchronization with the output pulse of said encoder.

Then a step S163 reads the content of the P-th memory cell, representing the latent image potential $V_s$, adds +200 V thereto and supplies thus added value as the developing bias voltage to the developing roller 5.

Figure 9:
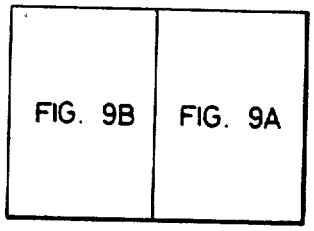
FIGS. 9A and 9B are a flow chart showing the control sequence in case of controlling the developing bias according to the maximum value of the detected potential.
Figure 9A:
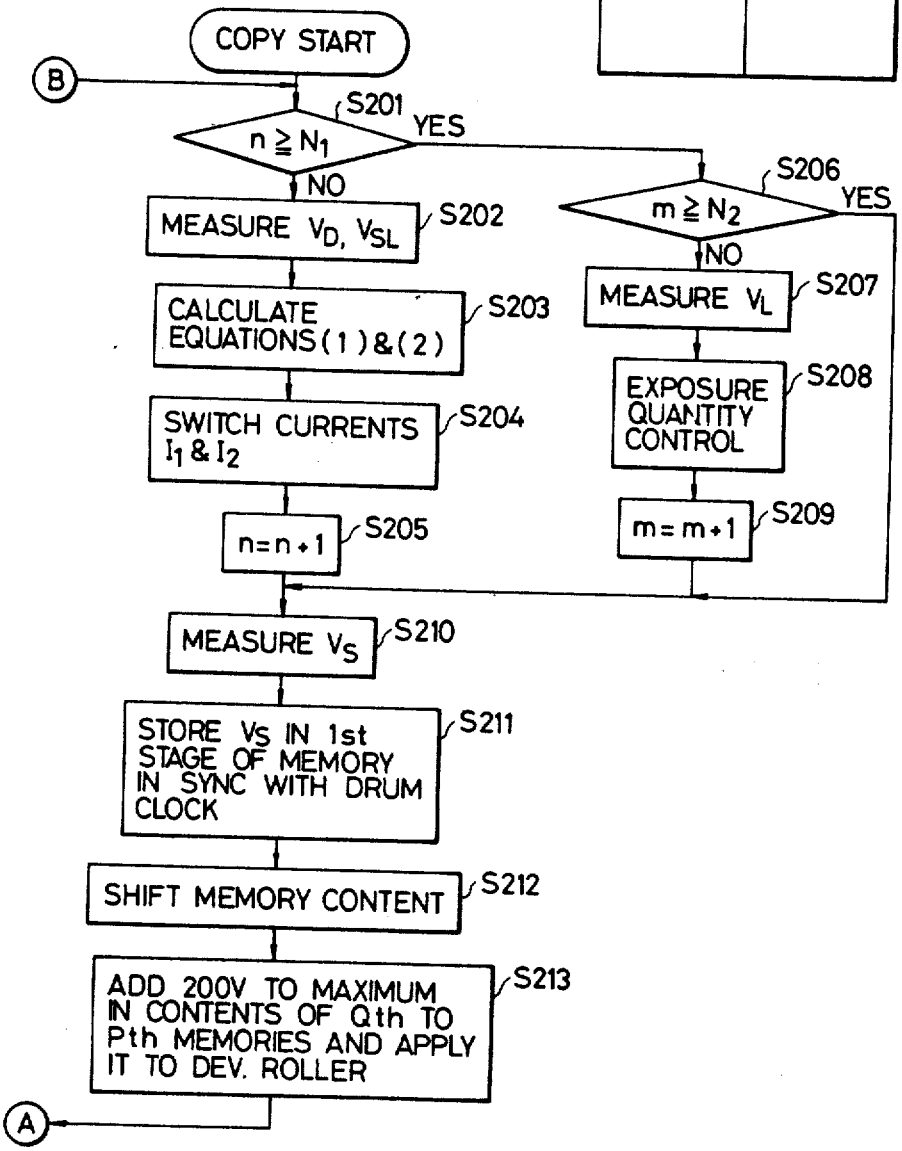
Figure 9B:
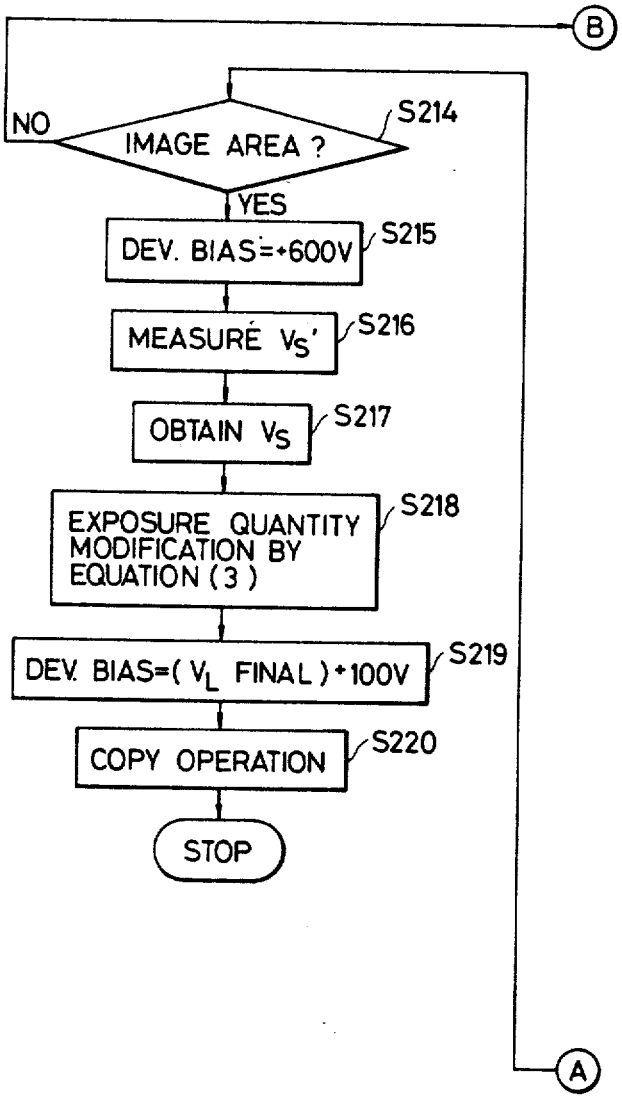

It is also possible to apply a developing bias voltage in response to the maximum value of the surface potentials detected in the non-image area. FIG. 9 shows a flow chart for such embodiment, wherein steps S201–S209 and S214–S220 are similar to the steps S101–S109 and S113–S119 shown in FIG. 6 and are therefore omitted from the following explanation.

In a step S210 the potential sensor 7 measures the latent image potential $v_s$ of the photosensitive drum 1.

In a succeeding step S211, the surface potential $v_s$ measured in the step S210 is stored in the first of serial P memory cells provided in the microcomputer 15. Said number P is equal to the number of pulses generated by a known encoder provided on the photosensitive drum 1, during rotation thereof from the potential sensor 7 to the developing roller 5. Said memory cells can be composed for example of a shift register.

A succeeding step S212 shifts the contents of the memory cells respectively to the succeeding memory cells in synchronization with the output pulse of said encoder.

A succeeding step S213 reads the maximum value of the contents from the Q-th to P-th memory cells ($Q \leqq P$), representing the latent image potential $V_s$, adds +200 V thereto and supplies the obtained sum as the developing bias voltage to the developing roller 5. Then the program proceeds to a step S216. The above-mentioned value Q is determined in such a manner that $(P-Q)T$ is equal to the rotating time of the photosensitive drum 1 from the potential sensor 7 to the developing roller 5, wherein T is the interval of the drum clock pulses. However the values of P, Q and T are determined in practice, in consideration also of the delay time in the measuring circuit, developing bias circuit etc.

Consequently said step S213 constantly provides the developing roller with a developing bias voltage which is 200 V higher than the maximum value of the latent image potentials present in an area from a position facing the potential sensor 7 to another position facing the developing roller 5, thereby preventing the toner deposition onto the photosensitive drum 1.

Figures 1, 10A:
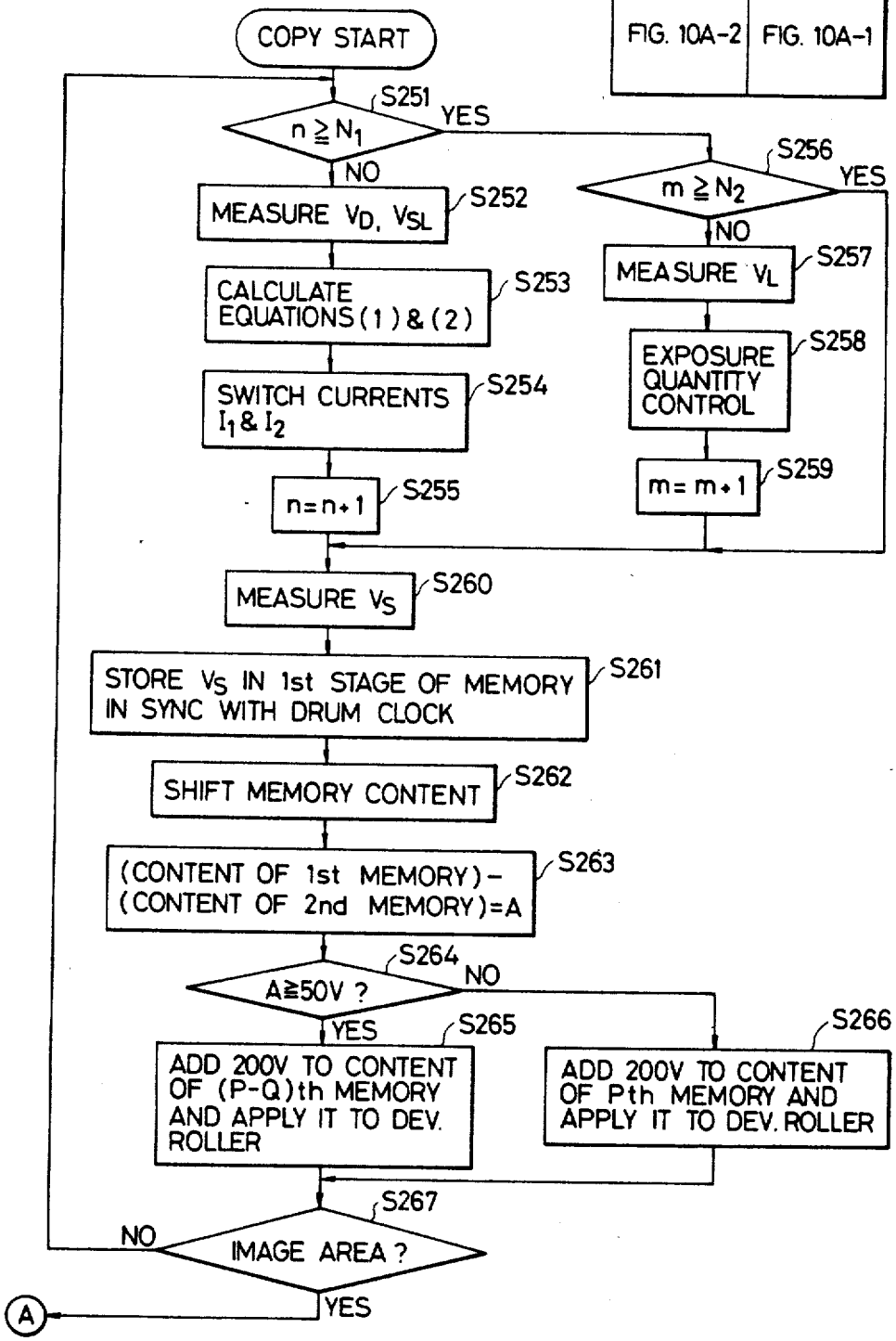
Figure 10A:
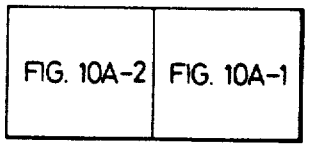
Figures 2, 10A:
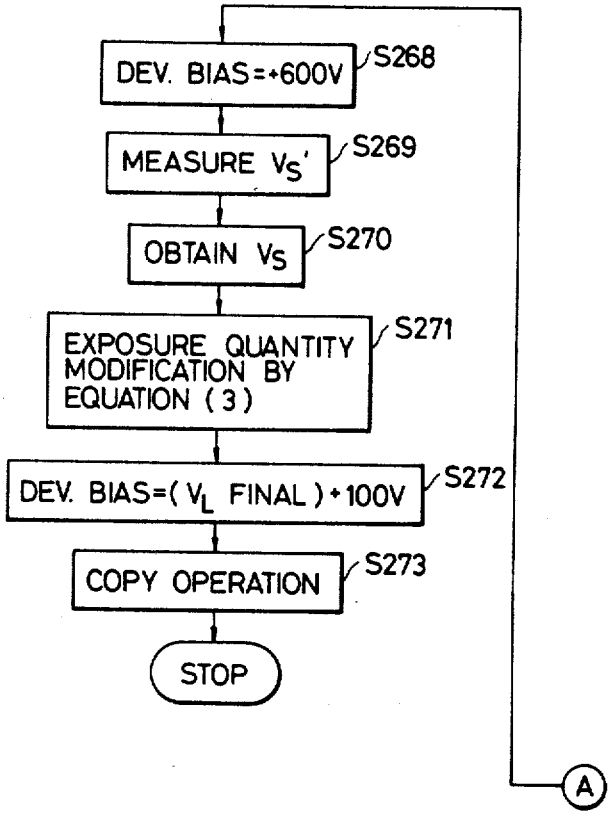
Figure 10B:
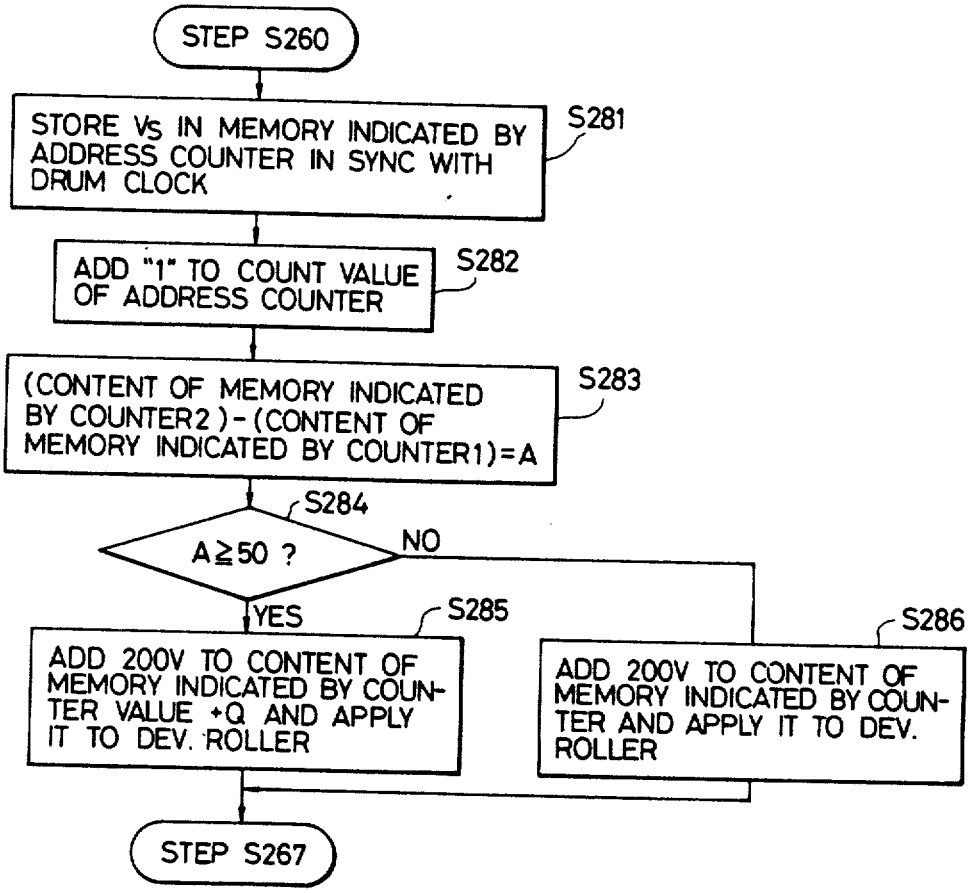

It is furthermore possible to control the developing bias voltage according to the change in the surface potential detected in the non-image area. FIGS. 10A and 10B show flow charts showing such embodiment, wherein steps S251–S259 and S267–S273 are similar to the steps S101–S109 and S113–S119 shown in FIG. 6 and are therefore omitted from the following explanation.

In a step S260 the potential sensor 7 measures the latent image potential $v_s$ of the photosensitive drum 1.

In a succeeding step S261, the surface potential $v_s$ measured in the step S260 is stored in the first of serial P memory cells provided in the microcomputer 15. Said number P is equal to the number of pulses generated by a known encoder provided on the photosensitive drum 1, during rotation thereof from the potential sensor 7 to the developing roller 5. Said memory cells can be composed for example of a shift register.

A succeedihg step S262 shifts the contents of the memory cells respectively to the succeeding memory cells in synchronization with the output pulse of said encoder.

Then, in a step S263, the content of a second memory cell, representing the result of an immediately preceding measurement, is subtracted from that of the first memory cell to obtain the difference A.

A subsequent step S264 discriminates whether the difference A determined in the step S263 is equal to or larger than 50 V. If the result is negative or affirmative, the program respectively proceeds to a step S266 or to a step S265.

The step S266 reads the content of the P-th memory cell, representing the latent image potential $V_s$, adds +200 V thereto, and supplies the obtained sum as the developing bias voltage to the developing roller 5, and program proceeds to a step S267. In this manner the developing roller 5 is always given a developing bias voltage which is 200 V higher than the potential of the latent image facing the developing roller, thereby preventing toner deposition onto the photosensitive drum 1.

On the other hand, the step S265 reads the content of a memory cell preceding the P-th memory cell by an arbitrary number Q, adds +200 V thereto, and supplies the obtained sum as the developing bias voltage to the developing roller 5, whereupon the program proceeds to a step S267. In this manner the toner deposition can be prevented even when the latent image potential shows a large variation.

The above-described developing bias control is repeated until the step S267 identifies the end of the non-image area. Said identification is in practice achieved at the completion of the controls for charging and exposure in the steps S251-S259.

The above-described developing bias control in the steps S260-S266 may also be conducted by an address counter as shown in FIG. 10B.

In the flow chart shown in FIG. 10B, a step S281 stores the surface potential $v_s$ measured in the step S260 into a memory cell, designated by an address counter, of P memory cells provided in the microcomputer 15.

Then a step S282 executes a stepwise increment of the value of said address counter, in synchronization with a pulse generated by a known encoder provided on the photosensitive drum 1 at a determined rotation angle thereof.

A succeeding step S283 reads a content younger by two and another content younger by one than the address indicated by said address counter, and subtracts the former from the latter to determined the difference A.

A step S284 determines whether said difference A is at least equal to 50 V. In affirmative or negative result, the program respectively proceeds to a step S285 or to a step S286.

The step S285 adds 200 V to the content of a memory cell of an address equal to the content of the address counter plus Q, and supplies the obtained sum as the developing bias voltage to the developing roller 5, wherein P and Q are determined in such a manner that (P−Q)T is equal to the rotating time of the photosensitive drum 1 from the potential sensor 7 to the developing roller 5, in which T is the interval of the drum clock pulses.

On the other hand the step S286 adds 200 V to the content of a memory cell of an address indicated by the address counter, and supplies the obtained sum to the developing roller 5.

The developing bias control in the steps S261-S266 and S281-S286 in FIGS. 10A and 10B supplies the developing roller 5 with a developing bias voltage which is 200 V higher than the latent image potential facing the developing roller 5 in case the change of the latent image potential is smaller than 50 V per drum clock pulse, or a developing bias voltage which is 200 V higher than the potential measured by the potential sensor 7 in case said change is at least equal to 50 V per drum clock pulse. Stated differently, the developing bias voltage is determined from the measured value irrespective of the rotating time of the photosensitive drum 1 in case the latent image potential shows a large change, while the developing bias voltage is determined in consideration of the delay cause by the rotation of the photosensitive drum in case said change is small.

Though the control is made on the developing bias voltage in the foregoing embodiments, the present invention is not limited to such embodiments but may be applied to the control of charge, exposure etc.

As explained in the foregoing, the present invention, in which the developing bias voltage is given in response to the surface status of the photosensitive member measured in the non-image area, allows prevention of useless toner deposition onto the photosensitive member, reduction of the toner consumption thereby increasing the number of image formations per a determined amount of toner, and extension of the service life of the cleaning blade. Also in comparison with the conventional apparatus, it is rendered possible to reduce the power of charge-eliminating lamps, such as the blank exposure lamp.

What is claimed is:

1. An image forming apparatus comprising:

(a) image forming means adapted for image formation on a recording member and comprising latent image forming means for latent image formation on said recording member and developing means for developing said latent image with a developer;

(b) detecting means for detecting the surface status of the non-image area on said recording member; and (c) control means for controlling an operational condition of said developing means for said non-image area in accordance with the detection result by said detecting means so as to prevent deposition of said developer onto said non-image area.

2. An image forming apparatus according to claim 1, wherein said control means is adapted to control a developing bias voltage to be supplied to said developing means in response to the result of detection of said detecting means.

3. An image forming apparatus according to claim 2, wherein said control means is adapted to determine said developing bias voltage by adding a determined value to the value detected by said detecting means in the non-image area.

4. An image forming apparatus according to claim 2, wherein said control means is adapted to provide said developing means with said developing bias voltage after a delay of a determined time from the detection by said detecting means.

5. An image forming apparatus according to claim 4, wherein said determined time corresponds to a time required by said recording member to move from a position for detecting image forming conditions by said detecting means to another position for developing the latent image by said developing means.

6. An image forming apparatus according to claim 1, wherein said control means is adapted to control said developing bias voltage in response to a determined value among the values detected by said detecting means in the non-image area.

7. An image forming apparatus according to claim 6, wherein said determined value is the maximum value.

8. An image forming apparatus according to claim 2, wherein said control means is adapted to control said developing bias voltage in response to the variation in said detected value.

9. An image forming apparatus according to claim 1, wherein said non-image area comprises an area for standardizing the image forming conditions in response to the output of said detecting means.

10. An image forming apparatus according to claim 9, wherein said non-image area further comprises an area for measuring the density of an original.

11. An image forming apparatus according to claim 1, wherein said surface status is the surface potential of said recording member.

12. An image forming apparatus according to claim 10, wherein said control means is adapted to control said developing means in response to the output of said detecting means in said standardizing area, and to control said developing means according to a determined value in said original density measuring area.

13. An image forming apparatus comprising:

(a) image forming means adapted for image formation on a recording member and comprising latent image forming means for latent image formation on said recording member and developing means for developing said latent image with developer;

(b) detecting means for detecting the density of an original by means of detecting the surface status of said recording member; and (c) control means for controlling an operational condition of said developing means for original density measurement area on said recording member in accordance with the detection result by said detecting means so as to prevent deposition of said developer onto said area.

14. An image forming apparatus according to claim 13, wherein said control means is adapted to control a developing bias voltage to be supplied to said developing means in response to the result of detection by said detecting means.

15. An image forming apparatus according to claim 14, wherein said control means determines said developing bias voltage by adding a determined value to the result of detection by said detecting means in an area for measuring the density of the original.

16. An image forming apparatus according to claim 14, wherein said control means is adapted to provide said developing means with said developing bias voltage after a delay of a determined time from the detection by said detecting means.

17. An image forming apparatus according to claim 16, wherein said determined time corresponds to a time required by said recording member to move from a position for detecting image forming conditions by said detecting means to another position for developing the latent image by said developing means.

18. An image forming apparatus according to claim 13, wherein said detecting means is adapted to detect the density by detecting the latent image potential in response to the original of which image is formed on said recording member.

19. An image forming apparatus comprising:

(a) image forming means for image formation on a recording member;

(b) detecting means for detecting image forming conditions in a non-image cycle; and (c) control means for controlling an operational condition of said image forming means in accordance with the output of said detecting means in the non-imaging cycle.

20. An image forming apparatus according to claim 19, wherein said image forming means includes a recording medium, and said detecting means detects the surface status of said recording medium.

21. An image forming apparatus according to claim 20, wherein said image forming means further including means for forming an electrostatic latent image on said recording medium, and means for developing the latent image on said recording medium; and said control means controls said developing means in accordance with the output of said detecting means.

22. An image forming apparatus according to claim 19, wherein said surface status is a surface potential.

23. An image forming apparatus according to claim 21, wherein said control means controls a bias voltage to be applied to said developing means.

24. An image forming apparatus according to claim 23, wherein said control means controls the bias voltage with a time delay corresponding to a distance from a detection position of said detecting means to a developing position of said developing means from detection timing of the surface status of said recording medium by said detecting means.

* * * * *

UNITED STATES PATENT AND TRADEMARK OFFICE

CERTIFICATE OF CORRECTION

PATENT NO. : 4,600,294

DATED : July 15, 1986

INVENTOR(S) : KOJI SUZUKI, ET AL.

It is certified that error appears in the above-identified patent and that said Letters Patent is hereby corrected as shown below:

IN THE DRAWINGS

Sheet 2, Fig. 2, "LAMP REGURATOR" should read --LAMP REGULATOR--.

COLUMN 4

Lines 54-55, "circuit 19 controls" should read --circuit 18 controls--.

COLUMN 5

Line 55, "supplies thus" should read --supplies the thus--.

COLUMN 6

Line 7, "supplies thus" should read --supplies the thus--.
Line 53, "10" should read --10--.
Line 57, "10," should read --10,--.

COLUMN 7

Line 16, "supply thus" should read --supply the thus--.
Lines 35-36, "reversal" should read --reverse--.

COLUMN 8

Line 5, "supples thus" should read --supplies the thus--.
Line 67, "succeedihg" should read --succeeding--.

UNITED STATES PATENT AND TRADEMARK OFFICE

CERTIFICATE OF CORRECTION

PATENT NO. : 4,600,294

DATED : July 15, 1986

INVENTOR(S) : KOJI SUZUKI, ET AL.

It is certified that error appears in the above-identified patent and that said Letters Patent is hereby corrected as shown below:

COLUMN 9

Line 16, "program" should read --the program--.
Line 50, "determined" should read --determine--.

COLUMN 10

Line 15, "cause" should read --caused--.

COLUMN 12

Line 33, "including" should read --includes--.

Signed and Sealed this

Ninth Day of August, 1988

*Attest:*

*Attesting Officer*

DONALD J. QUIGG

*Commissioner of Patents and Trademarks*